US010254074B2

(12) United States Patent
McPherson

(10) Patent No.: US 10,254,074 B2
(45) Date of Patent: Apr. 9, 2019

(54) COMPOUND BOW WITH OFFSET SYNCHRONIZER

(71) Applicant: MCP IP, LLC, Sparta, WI (US)

(72) Inventor: Mathew A. McPherson, Norwalk, WI (US)

(73) Assignee: MCP IP, LLC, Sparta, WI (US)

( * ) Notice: Subject to any disclaimer, the term of this patent is extended or adjusted under 35 U.S.C. 154(b) by 0 days.

(21) Appl. No.: 15/679,055

(22) Filed: Aug. 16, 2017

(65) Prior Publication Data

US 2018/0003458 A1 Jan. 4, 2018

Related U.S. Application Data

(63) Continuation of application No. 14/952,815, filed on Nov. 25, 2015.

(60) Provisional application No. 62/085,208, filed on Nov. 26, 2014.

(51) Int. Cl.
*F41B 5/10* (2006.01)
*F41B 5/12* (2006.01)

(52) U.S. Cl.
CPC ..... *F41B 5/123* (2013.01)

(58) Field of Classification Search
None
See application file for complete search history.

(56) References Cited

U.S. PATENT DOCUMENTS 3,486,495 A 12/1969 Allen
3,990,425 A 11/1976 Ketchum
4,064,862 A 12/1977 Groner
4,078,538 A 3/1978 Shepley
4,326,832 A 4/1982 Ikeda et al.
4,337,749 A 7/1982 Barna
4,338,910 A 7/1982 Darlington
4,401,097 A 8/1983 Simonds
4,438,753 A 3/1984 Simonds
4,440,142 A 4/1984 Simonds
4,461,267 A 7/1984 Simonds et al.
4,515,142 A 5/1985 Nurney
4,519,374 A 5/1985 Miller
4,562,824 A 1/1986 Jennings
4,660,536 A 4/1987 McPherson
4,669,445 A 6/1987 Schaar
4,756,296 A 7/1988 Darlington
4,774,927 A 10/1988 Lasron
4,838,236 A 6/1989 Kudlacek
4,926,832 A 5/1990 Darlington
(Continued)

FOREIGN PATENT DOCUMENTS

CA 2183305 2/1997

*Primary Examiner* — Melba Bumgarner
*Assistant Examiner* — Amir Klayman

(57) ABSTRACT

In some embodiments, an archery bow comprises a frame supporting a first limb and a second limb. A first rotatable member is supported by the first limb and arranged to rotate about a first rotation axis. The first rotatable member comprises a cam track. A second rotatable member is supported by the second limb and arranged to rotate about a second rotation axis. The second rotatable member comprises a synchronizer track. A bowstring extends between the first rotatable member and the second rotatable member. A power cable is arranged to be taken up on the cam track and fed out from the synchronizer track as the bow is drawn. The synchronizer track is circular and a centerpoint of the synchronizer is offset from the second rotation axis.

17 Claims, 12 Drawing Sheets

(56) References Cited

U.S. PATENT DOCUMENTS

| | | | |
|---|---|---|---|
| 4,926,833 | A | 5/1990 | Darlington |
| 4,967,721 | A | 11/1990 | Larson |
| 4,976,250 | A | 12/1990 | Jeffrey |
| 4,986,250 | A | 1/1991 | Darlington |
| 5,092,309 | A | 3/1992 | Beaton |
| 5,211,155 | A | 5/1993 | Zamojski |
| 5,301,651 | A | 4/1994 | LaBorde et al. |
| 5,368,006 | A | 11/1994 | McPherson |
| 5,381,777 | A | 1/1995 | Mitchell et al. |
| 5,433,792 | A | 7/1995 | Darlington |
| 5,505,185 | A | 4/1996 | Miller |
| 5,649,522 | A | 7/1997 | Troncoso |
| 5,678,529 | A | 10/1997 | Larson |
| 5,782,229 | A | 7/1998 | Evans et al. |
| 5,791,322 | A | 8/1998 | McPherson |
| 5,791,323 | A | 8/1998 | Dumlap |
| 5,890,480 | A | 4/1999 | McPherson |
| 5,934,265 | A | 8/1999 | Darlington |
| 5,960,778 | A | 10/1999 | Larson |
| 5,975,067 | A | 11/1999 | Strother |
| 6,035,840 | A | 3/2000 | McPherson |
| 6,082,347 | A | 7/2000 | Darlington |
| 6,112,732 | A | 9/2000 | Larson |
| 6,247,466 | B1 | 6/2001 | McPherson |
| 6,321,736 | B1 | 11/2001 | McPherson |
| RE37,544 | E | 2/2002 | Darlington |
| 6,443,139 | B1 | 9/2002 | McPherson |
| 6,446,619 | B1 | 9/2002 | McPherson |
| 6,516,790 | B1 | 2/2003 | Darlington |
| 6,666,202 | B1 | 12/2003 | Darlington |
| 6,688,295 | B1 | 2/2004 | Miller |
| 6,792,930 | B1 | 9/2004 | Kronengold et al. |
| 6,990,970 | B1 | 1/2006 | Darlington |
| 6,994,079 | B1 | 2/2006 | Darlington |
| 7,047,958 | B1 | 5/2006 | Colley |
| 7,188,615 | B2 | 3/2007 | Chang |
| 7,305,979 | B1 | 12/2007 | Yehle |
| 7,441,555 | B1 | 10/2008 | Larson |
| 7,946,281 | B2 | 5/2011 | Miller |
| 7,997,259 | B2 | 8/2011 | Wilson |
| 8,020,544 | B2 | 9/2011 | McPherson et al. |
| 2008/0135032 | A1 | 6/2008 | Islas |
| 2009/0000607 | A1 | 1/2009 | Miller |
| 2009/0188482 | A1 | 7/2009 | Strother |
| 2009/0255520 | A1 | 10/2009 | Strother |
| 2009/0288650 | A1 | 11/2009 | Batdorf |
| 2010/0269808 | A1 | 10/2010 | Evans |
| 2015/0233664 | A1 | 8/2015 | McPherson |

COMPOUND BOW WITH OFFSET SYNCHRONIZER

CROSS-REFERENCE TO RELATED APPLICATIONS

This application is a continuation of U.S. patent application Ser. No. 14/952,815, filed Nov. 25, 2015, which claims the benefit of U.S. Patent Application No. 62/085,208, filed Nov. 26, 2014, the entire disclosure of which is hereby incorporated herein by reference.

BACKGROUND OF THE INVENTION

This invention relates generally to compound bows and more specifically to compound bows having a synchronizing feature.

Compound bows having synchronizing features are known in the art, for example as disclosed by Ketchum in U.S. Pat. No. 3,990,425, the entire disclosure of which is hereby incorporated herein by reference. Since the Ketchum invention, compound bows have continued to advance in design. A more advanced design can provide better performance, but the advanced design generally more complicated, and may be more prone to coming out of adjustment, etc.

There remains a need for novel bow designs that provide benefits over previous designs.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, an archery bow comprises a frame supporting a first limb and a second limb. A first rotatable member is supported by the first limb and arranged to rotate about a first rotation axis. The first rotatable member comprises a cam track. A second rotatable member is supported by the second limb and arranged to rotate about a second rotation axis. The second rotatable member comprises a synchronizer track. A bowstring extends between the first rotatable member and the second rotatable member. A power cable is arranged to be taken up on the cam track and fed out from the synchronizer track as the bow is drawn. The synchronizer track is circular and a centerpoint of the synchronizer is offset from the second rotation axis.

In some embodiments, a rotatable member for use in a compound bow comprises a body arranged to rotate about an axis comprising a bowstring track, a power cable track and a synchronizer track. The bowstring track defines a circular arc, the power cable track defines a circular arc and the synchronizer track defines a circular arc. Each of the bowstring track, power cable track and synchronizer track define a centerpoint that is offset from the rotation axis.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
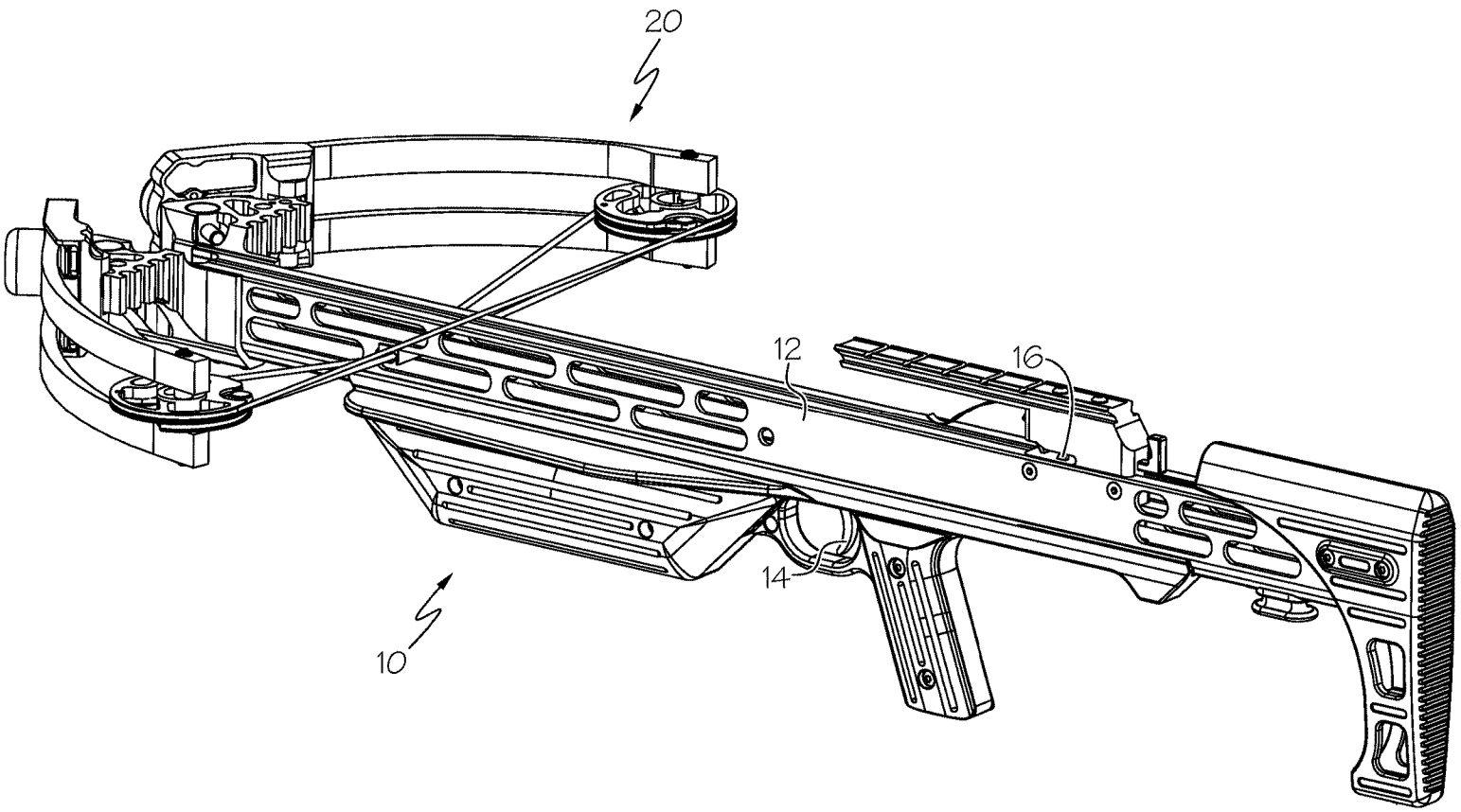
FIG. 1 shows an embodiment of a crossbow.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

The compound bow disclosed herein can be used in any suitable device, such as crossbows and traditional vertical bows.

FIG. 1 shows an embodiment of a crossbow 10 comprising a compound bow 20. Desirably, the crossbow 8 comprises a stock 12 attached to the compound bow 20, a trigger 14 and a string latch 16.

In some embodiments, a crossbow 10 comprises any suitable feature or combination of features as disclosed in US 2012/0298087, US 2013/0118463, US 2014/0069401, US 2014/0069402, US 2014/0069403, US 2014/0069404 and US 2014/0261357, the entire disclosures of which are hereby incorporated herein by reference.

Figure 2:
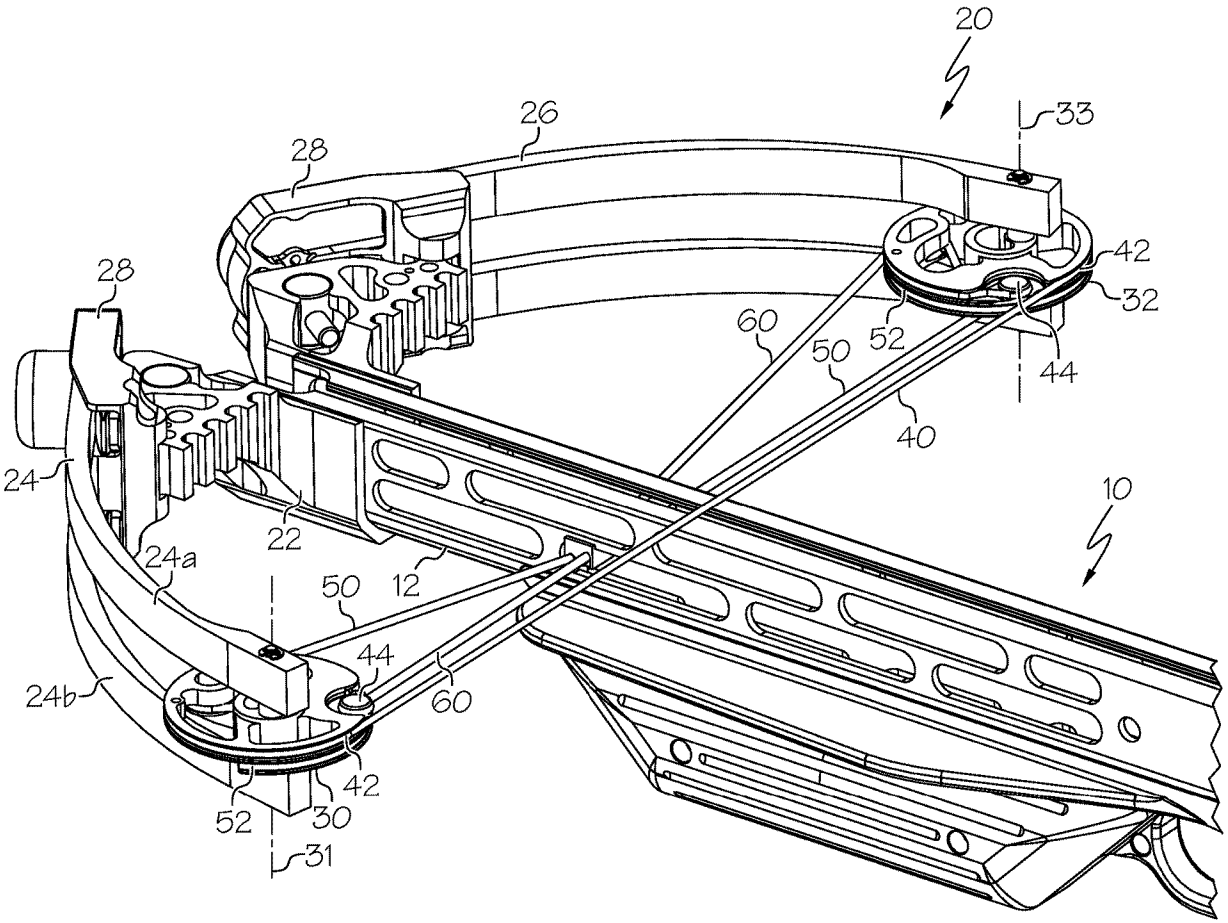
FIG. 2 shows an embodiment of rotating members.

FIG. 2 shows an embodiment of a compound bow 20 portion of a crossbow 10 in greater detail. Desirably, the compound bow 20 comprises a frame 22 arranged to support a first limb 24 and a second limb 26. When the compound bow 20 is used in a crossbow 10, the frame 22 can comprise a prod 18 that is attached to the stock 12. In some embodiments, each limb 24, 26 is received in a limb cup 28, for example as disclosed in U.S. Pat. No. 8,453,635. Desirably, the first limb 24 supports a first rotatable member 30 and the second limb supports a second rotatable member 32. The first rotatable member 30 is arranged to rotate about a first axis 31 and the second rotatable member 32 is arranged to rotate about a second axis 33. In some embodiments, one or more limbs (e.g. 24) comprise split limb elements 24*a*, 24*b*, and the associated rotatable member (e.g. 30) is oriented between the split limb elements 24*a*, 24*b*. In some embodiments, the shapes of the rotatable members 30, 32 are mirror images of one another.

Figure 3:
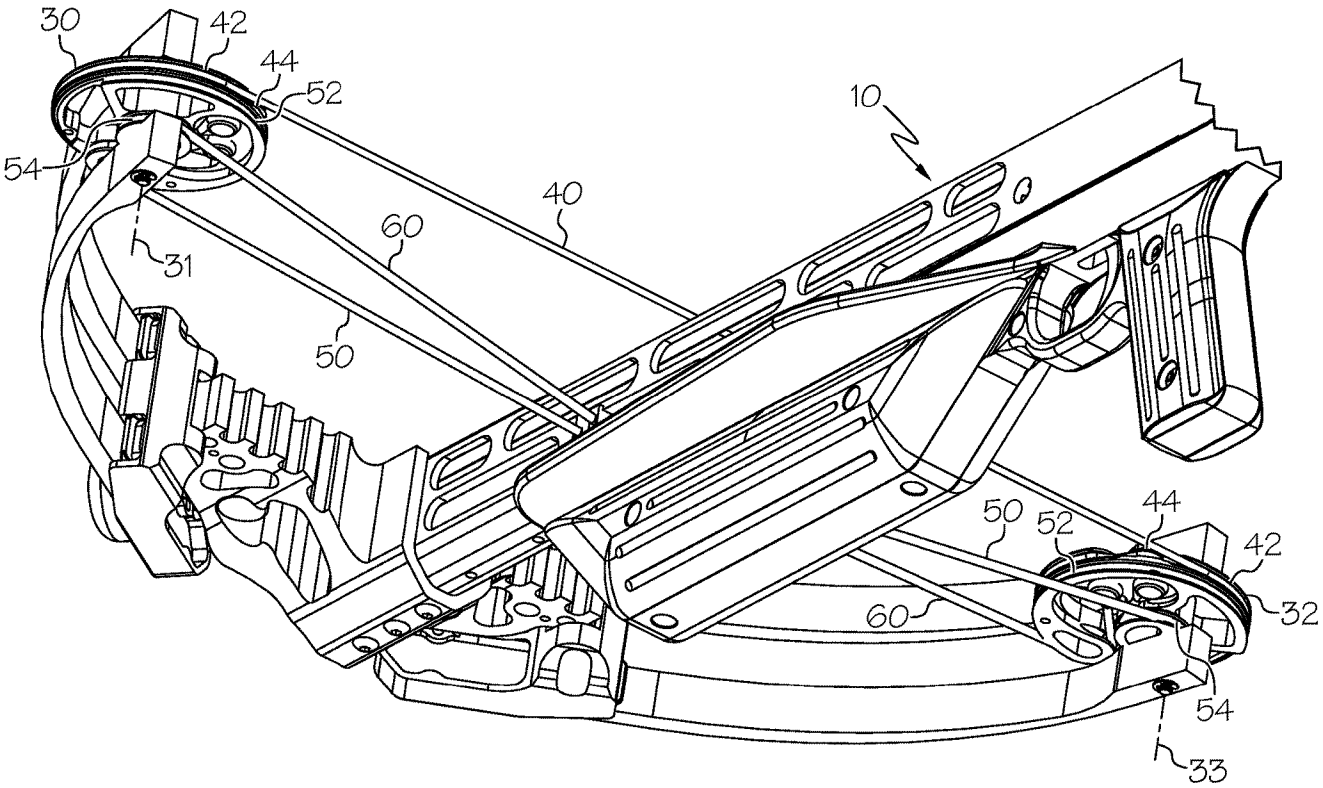
FIG. 3 shows an underside view of an embodiment of rotating members.
Figure 4:
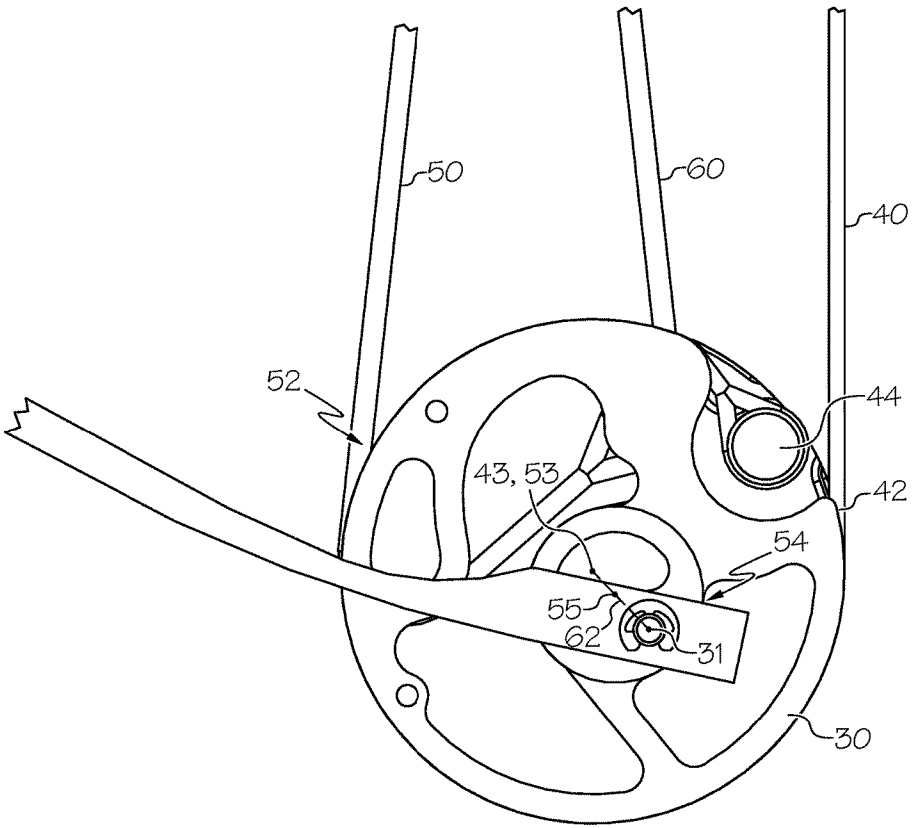
FIG. 4 shows an embodiment of a rotatable member.

FIG. 3 shows an underside view of an embodiment of a crossbow 10. FIG. 4 shows a top view of an embodiment of the first rotatable member 30, and FIG. 5 shows a bottom view.

Figure 5:
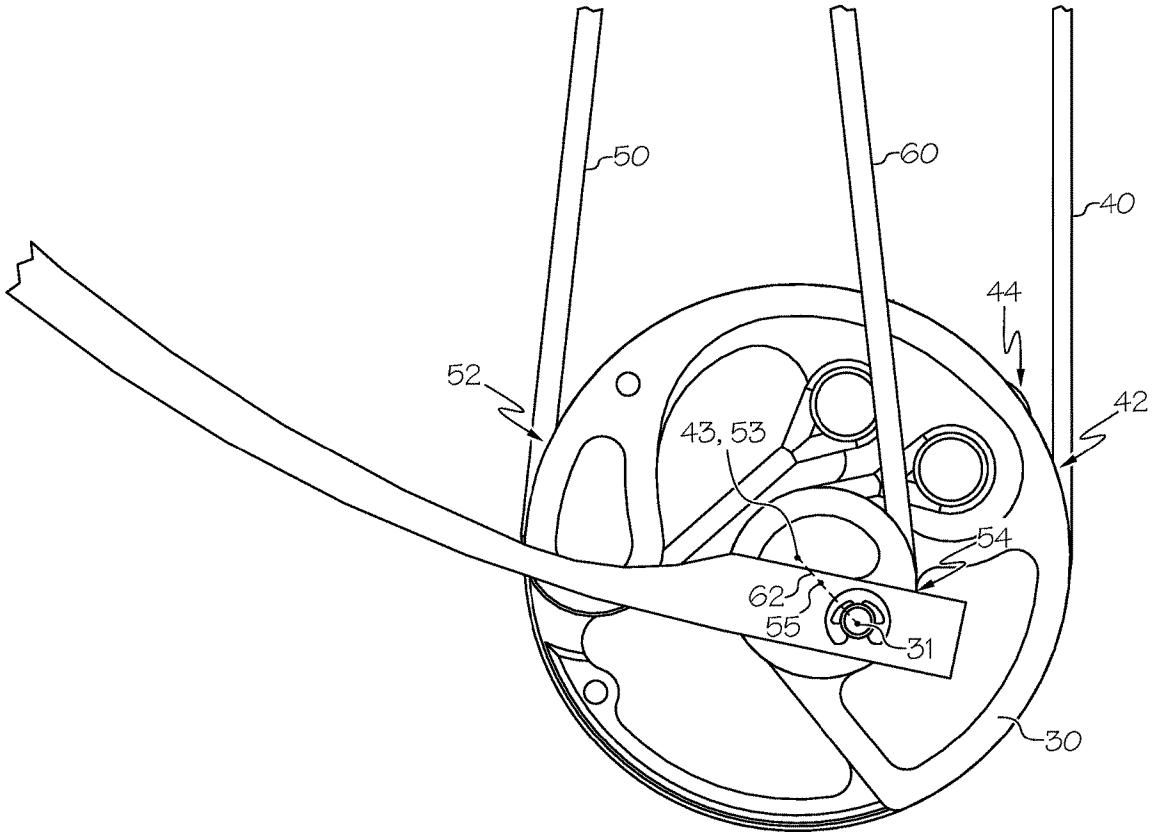
FIG. 5 shows the rotatable member of FIG. 4 from the opposite side.

With reference to FIGS. 3-5, desirably, the compound bow 20 comprises a bowstring 40 that extends between the first rotatable member 30 and the second rotatable member 32. In some embodiments, a first end of the bowstring 40 is attached to the first rotatable member 30 and a second end of the bowstring 40 is attached to the second rotatable member 32.

In some embodiments, each rotatable member 30, 32 comprises a bowstring track 42 and a bowstring terminal 44. In a brace condition, a portion of the bowstring 40 occupies the bowstring track 42 and terminates on the bowstring terminal 44. As the bowstring 40 is drawn, the rotatable members 30, 32 rotate and bowstring is fed out from the bowstring tracks 42.

In some embodiments, the bowstring track 42 is circular in shape. For example, a centerpoint 43 (see FIGS. 4&5) can be defined, and a radius is defined between the centerpoint 43 and the bowstring track 42. In some embodiments, a central axis of the bowstring track 42 is circular in shape, extends in a circle or extends along an arc having a constant radius. In some embodiments, the centerpoint 43 of the bowstring track 42 is offset from the rotatable member axis 31.

Desirably, the compound bow 20 comprises a first power cable 50 extending between the first and second rotatable members 30, 32. Desirably, the first power cable 50 is arranged to pull the limbs 24, 26 together as the bow 20 is drawn. In some embodiments, the compound bow 20 comprises a second power cable 60. In some embodiments, the first and second power cables 50, 60 are mirrored.

In some embodiments, the one or both rotatable member (s) 30, 32 comprise a power cable track 52 and a synchronizer track 54. In some embodiments, each power cable 50, 60 comprises a first end arranged to be taken up by the power cable track 52 of one roatable member (e.g. 30) and a second end arranged to be fed out from the synchronizer track 54 of the other rotatable member (e.g. 32) as the bow is drawn.

In some embodiments, the power cable track 52 defines a circular shape. For example, a centerpoint 53 (see FIGS. 4&5) can be defined, and a radius is defined between the centerpoint 53 and the power cable track 52. In some embodiments, a central axis of the power cable track 52 extends along a circular arc, for example having a constant radius. In some embodiments, the centerpoint 53 is offset from the rotatable member axis 31.

In some embodiments, the centerpoint 53 of the power cable track 52 is aligned with the centerpoint 43 of the bowstring track 42. From the viewing angle of FIG. 4 or 5, the centerpoints 43, 53 are juxtaposed. As the bowstring track 42 is generally offset from the power cable track 52 (e.g. vertically offset), in some embodiments, a line extending between the centerpoints 43, 53 extends parallel to the axis of rotation 31.

In some embodiments, the bowstring track 42 extends parallel to the power cable track 52. In some embodiments, a radius distance from the centerpoint 43 to the bowstring track 42 is the same as a radius distance from the centerpoint 53 to the power cable track 52.

In some embodiments, the synchronizer track 54 defines a circular shape. For example, a centerpoint 55 (see FIGS. 4&5) can be defined, and a radius is defined between the centerpoint 55 and the synchronizer track 54. In some embodiments, a central axis of the synchronizer track 54 extends along an arc that has a constant radius from the centerpoint 55.

Desirably, the centerpoint 55 of the synchronizer track 54 is offset from the rotatable member axis 31.

In some embodiments, a line/axis 62 extends between the axis of rotation 31 and the centerpoint 43 of the bowstring track 42, and the centerpoint 55 of the synchronizer track 54 is oriented on the line/axis 62. In some embodiments, a line/axis 62 extends between the axis of rotation 31 and the centerpoint 53 of the power cable track 52, and the centerpoint 55 of the synchronizer track 54 is oriented on the line/axis 62.

Figure 6:
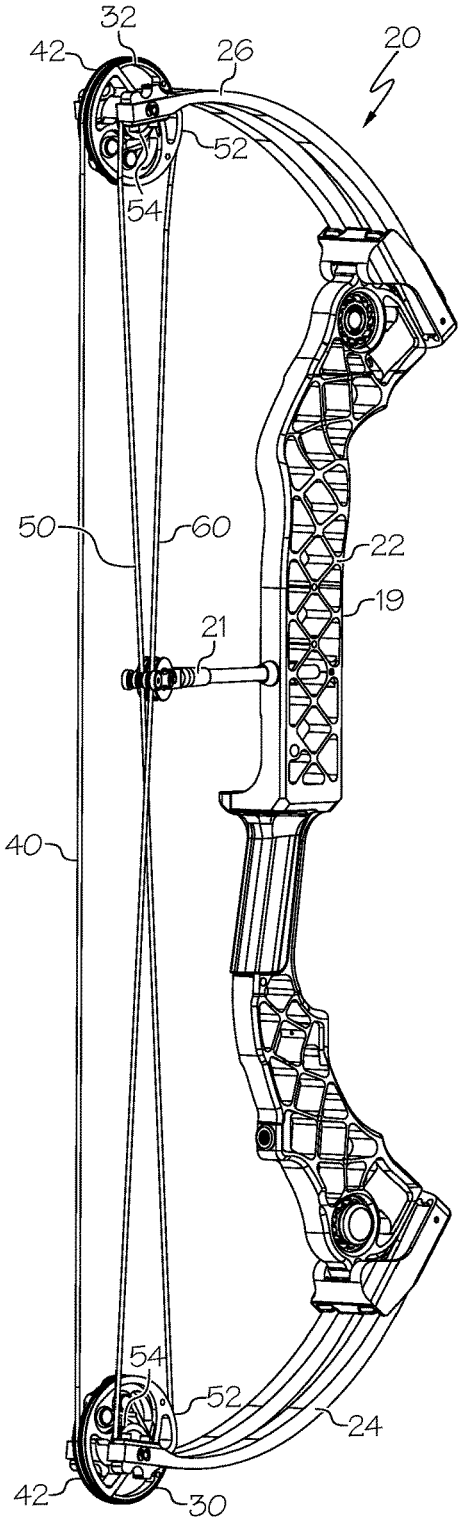
FIG. 6 shows an embodiment of a vertical bow.

FIG. 6 shown an embodiment of a vertical bow having rotatable members 30, 32 as described herein. The frame 22 can comprise a riser 19 that supports the limbs 24, 26. The riser 19 can support a cable guard 21 arranged to bias cables in a direction lateral to the shooting axis.

The bow 20 desirably comprises a bowstring 40 and a power cable 50. In some embodiments, the bow 20 comprises a second power cable 60. The features of the rotatable members 30, 32 can be similar to other rotatable members 30, 32 as described herein, for example comprising a bowstring track 42, a power cable track 52 and a synchronizer track 54.

Figure 7:
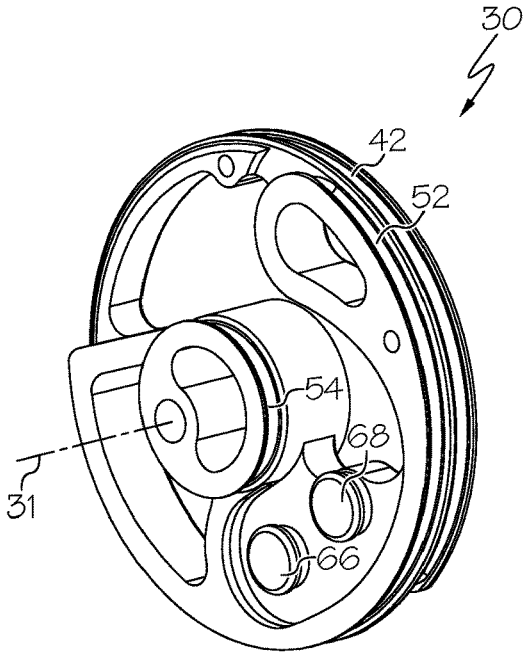
FIG. 7 shows an angled view of an embodiment of a rotatable member.
Figure 8:
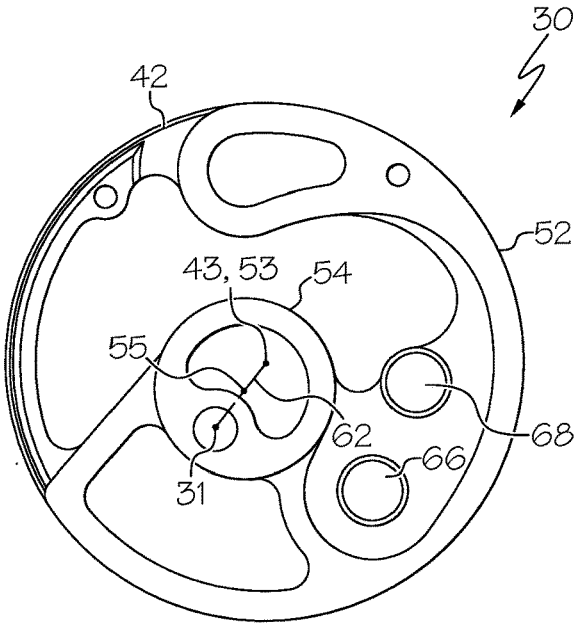
FIG. 8 shows the rotatable member of FIG. 7 from another angle.

FIG. 7 shows an embodiment of a rotatable member 30 viewed at an angle. FIG. 8 shows the rotatable member 30 of FIG. 7 as viewed along the axis of rotation 31.

In some embodiments, a bowstring track 42 extends around a perimeter of the rotatable member 30. In some embodiments, the bowstring track 42 follows a circular arc having a centerpoint 43 that is offset from the axis of rotation 31.

In some embodiments, a power cable track 52 extends around a perimeter of the rotatable member 30. In some embodiments, the power cable track 52 follows a circular arc having a centerpoint 53 that is offset from the axis of rotation 31.

In some embodiments, the centerpoint 43 of the bowstring track 42 is aligned with the centerpoint 53 of the power cable track 52. This is shown in FIG. 8. In some embodiments, a reference line that extends through both centerpoints 43, 53 extends parallel to the axis of rotation 31.

In some embodiments, a radius of the bowstring track 42 is similar to a radius of the power cable track 52. In some embodiments, the bowstring track 42 and power cable track 52 extend parallel to one another, for example being oriented in parallel planes.

In some embodiments, the rotatable member 30 comprises a synchronizer track 54. In some embodiments, the synchronizer track 54 follows a circular arc having a centerpoint 55 that is offset from the axis of rotation 31.

In some embodiments, a line/axis 62 extends between the axis of rotation 31 and the centerpoint 43 of the bowstring track 42, and the centerpoint 55 of the synchronizer track 54 is oriented on the line/axis 62. In some embodiments, a line/axis 62 extends between the axis of rotation 31 and the centerpoint 53 of the power cable track 52, and the centerpoint 55 of the synchronizer track 54 is oriented on the line/axis 62. Due to the offset locations of the centerpoints 43, 53, 55, the line/axis 62 as viewed in FIG. 8 represents a plane, wherein the axis of rotation 31 extends in the plane and the centerpoints 43, 53, 55 are oriented in the plane.

In some embodiments, a rotatable member 30 includes a first terminal post 66 and a second terminal post 68, which are both oriented in a common plane. In some embodiments, the terminal posts 66, 68 are oriented in a plane that includes the power cable track 52.

Figure 9:
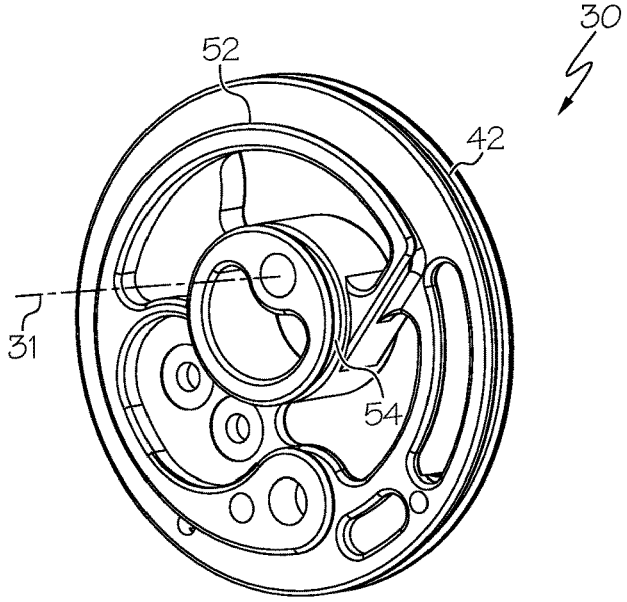
FIG. 9 shows an angled view of another embodiment of a rotatable member.
Figure 10:
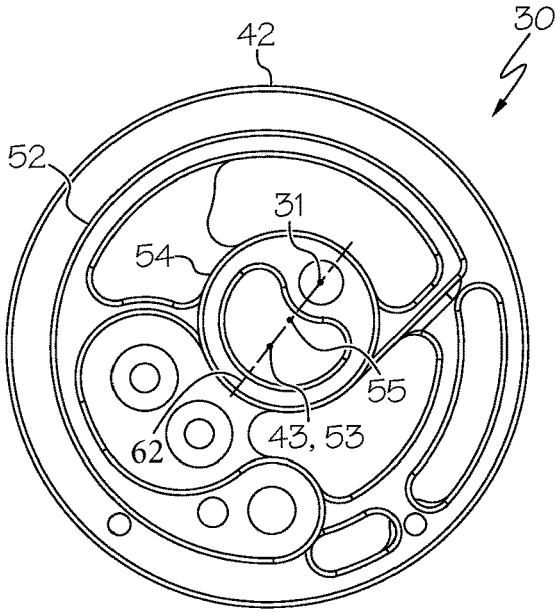
FIG. 10 shows the rotatable member of FIG. 9 from another angle.

FIG. 9 shows an embodiment of a rotatable member 30 viewed at an angle. FIG. 10 shows the rotatable member 30 of FIG. 9 as viewed along the axis of rotation 31.

In some embodiments, a bowstring track 42 extends around a perimeter of the rotatable member 30. In some embodiments, the bowstring track 42 follows a circular arc having a centerpoint 43 that is offset from the axis of rotation 31.

In some embodiments, the power cable track 52 follows a circular arc having a centerpoint 53 that is offset from the axis of rotation 31.

In some embodiments, the centerpoint 43 of the bowstring track 42 is aligned with the centerpoint 53 of the power cable track 52. This is shown in FIG. 10. In some embodiments, a reference line that extends through both centerpoints 43, 53 extends parallel to the axis of rotation 31.

In some embodiments, a radius of the bowstring track 42 is different from a radius of the power cable track 52. In some embodiments, a radius of the power cable track 52 is smaller than a radius of the bowstring track 42. In some embodiments, the bowstring track 42 and power cable track 52 comprise offset curves.

In some embodiments, the rotatable member 30 comprises a synchronizer track 54. In some embodiments, the synchronizer track 54 follows a circular arc having a centerpoint 55 that is offset from the axis of rotation 31.

In some embodiments, a line/axis 62 extends between the axis of rotation 31 and the centerpoint 43 of the bowstring track 42, and the centerpoint 55 of the synchronizer track 54 is oriented on the line/axis 62. In some embodiments, a line/axis 62 extends between the axis of rotation 31 and the centerpoint 53 of the power cable track 52, and the centerpoint 55 of the synchronizer track 54 is oriented on the line/axis 62. Due to the offset locations of the centerpoints 43, 53, 55, the line/axis 62 as viewed in FIG. 10 represents a plane, wherein the axis of rotation 31 extends in the plane and the centerpoints 43, 53, 55 are oriented in the plane.

Figure 11:
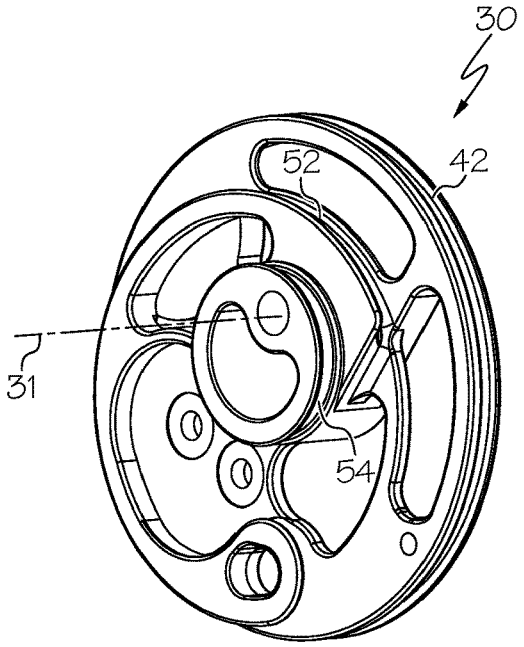
FIG. 11 shows an angled view of another embodiment of a rotatable member.
Figure 12:
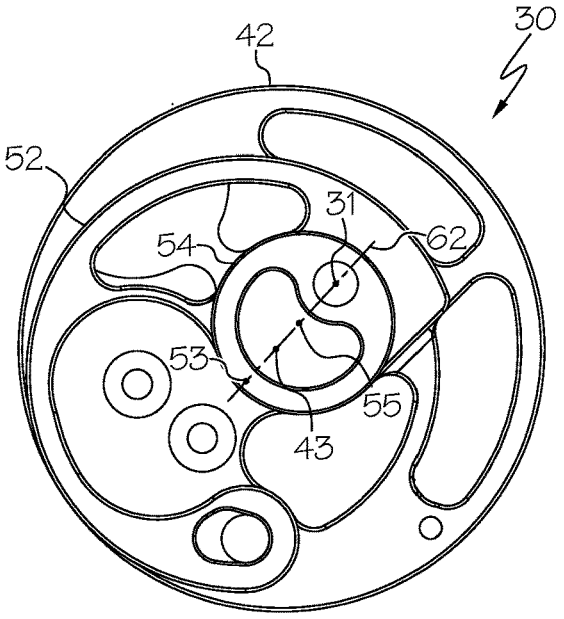
FIG. 12 shows the rotatable member of FIG. 11 from another angle.

FIG. 11 shows an embodiment of a rotatable member 30 viewed at an angle. FIG. 12 shows the rotatable member 30 of FIG. 11 as viewed along the axis of rotation 31.

In some embodiments, a bowstring track 42 extends around a perimeter of the rotatable member 30. In some embodiments, the bowstring track 42 follows a circular arc having a centerpoint 43 that is offset from the axis of rotation 31.

In some embodiments, the power cable track 52 follows a circular arc having a centerpoint 53 that is offset from the axis of rotation 31.

In some embodiments, the centerpoint 43 of the bowstring track 42 is offset from the centerpoint 53 of the power cable track 52.

In some embodiments, a radius of the bowstring track 42 is different from a radius of the power cable track 52. In some embodiments, a radius of the power cable track 52 is smaller than a radius of the bowstring track 42. In some embodiments, the bowstring track 42 and power cable track 52 are non-concentric.

In some embodiments, the rotatable member 30 comprises a synchronizer track 54. In some embodiments, the synchronizer track 54 follows a circular arc having a centerpoint 55 that is offset from the axis of rotation 31.

In some embodiments, a line/axis 62 extends between the axis of rotation 31 and the centerpoint 43 of the bowstring track 42, and the centerpoint 55 of the synchronizer track 54 is oriented on the line/axis 62. In some embodiments, a line/axis 62 extends between the axis of rotation 31 and the centerpoint 53 of the power cable track 52, and the centerpoint 55 of the synchronizer track 54 is oriented on the line/axis 62. Due to the offset locations of the centerpoints 43, 53, 55, the line/axis 62 as viewed in FIG. 10 represents a plane, wherein the axis of rotation 31 extends in the plane and the centerpoints 43, 53, 55 are oriented in the plane.

Figure 13:
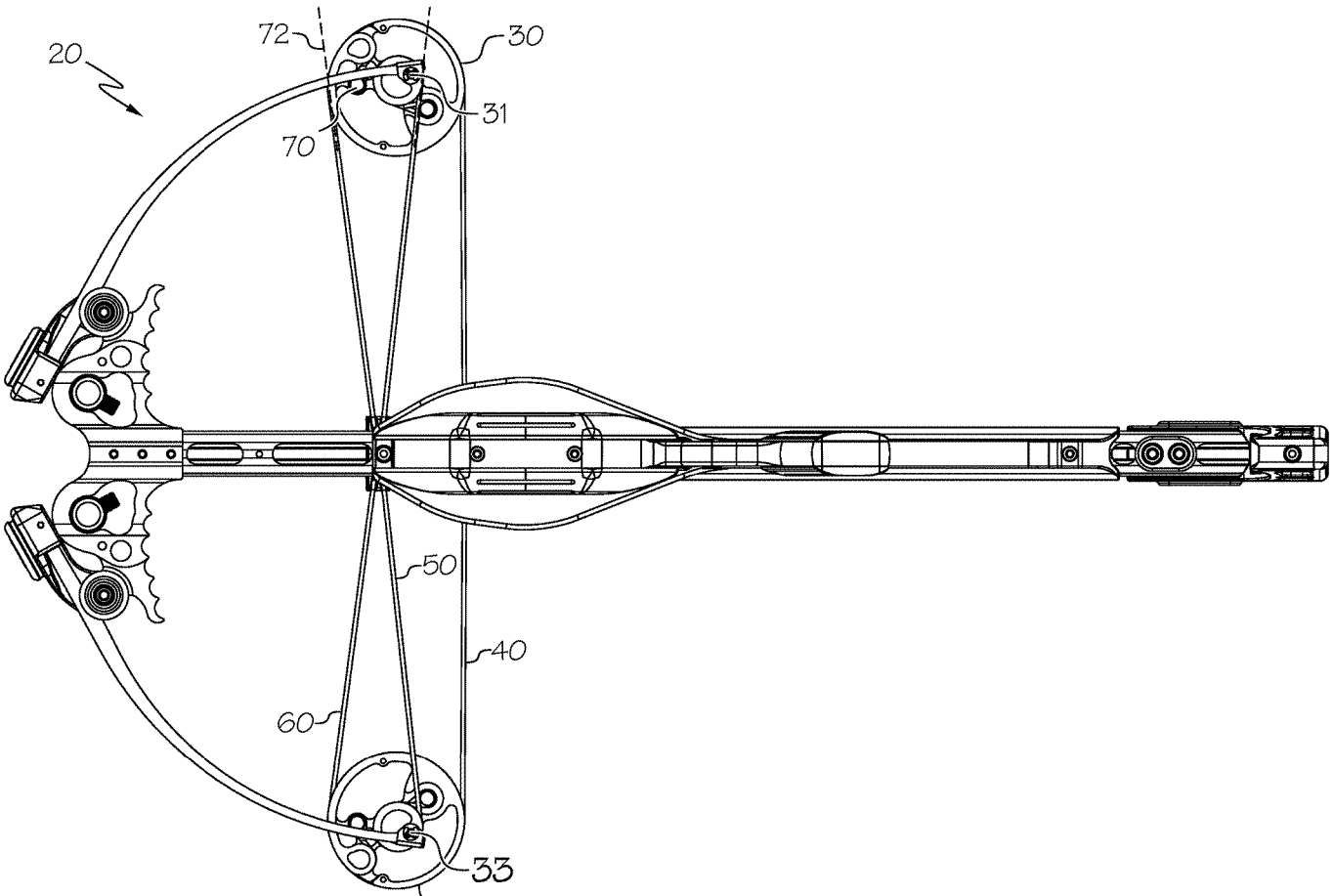
FIG. 13 shows an embodiment of a compound bow in a brace condition.
Figure 14:
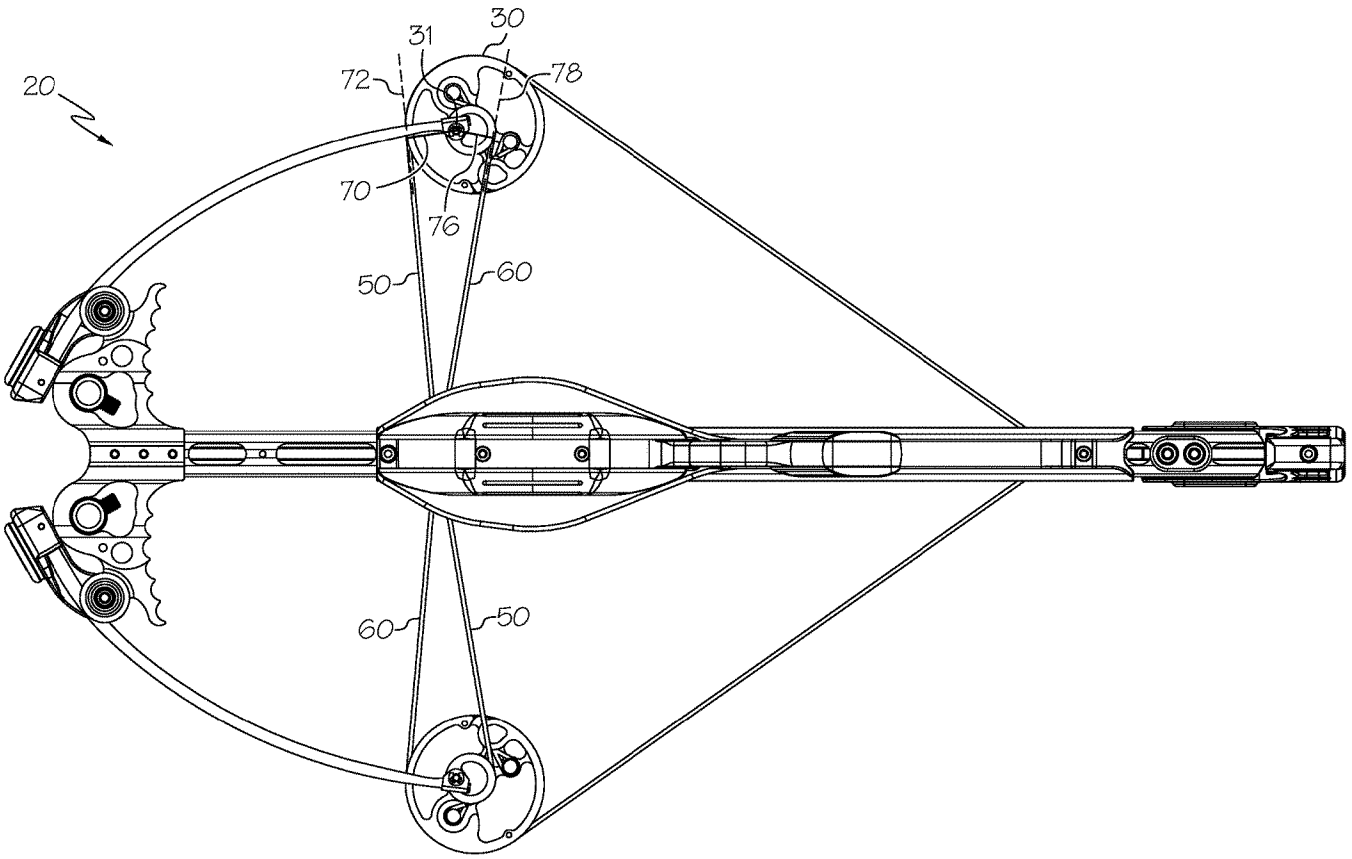
FIG. 14 shows an embodiment of a compound bow in a drawn condition.

FIG. 13 shows an embodiment of a compound bow 20 in an undrawn or brace condition. FIG. 14 shows the crossbow of FIG. 13 in a fully drawn condition.

In some embodiments, each of the cables 50, 60 applies a force to each rotatable member 30, 32. The force from each cable 50, 60 places a torque on a rotatable member 30, 32 about its respective rotation axis 31, 33. The magnitude of the torque applied by a given cable (e.g. 50) is equal to the tension force in the cable multiplied by the moment arm distance (e.g. 70). The moment arm distance 70 is perpendicular to a vector 72 of the tensile force in the cable 50 and measured between the rotation axis 31 and the vector 72.

In some embodiments, the moment arm of the synchronizing end of each power cable 50, 60 increases as the bow is drawn. FIG. 13 shows the moment arm of the synchronizing end of each power cable 50, 60 being s relatively short distance. FIG. 14 shows the bow at full draw, and the moment arm of the synchronizing ends of the cables 50, 60 is greater than in FIG. 13. For example, a moment arm 76 of the synchronizing end of the second power cable 60 at the first rotatable member 30 is greater in the drawn condition than in the brace condition. In some embodiments, the moment arm 76 of the synchronizing end of a power cable 60 reaches a maximum value when the bow is at full draw. In some embodiments, the moment arm 70 of the cam end of a power cable 50 reaches a minimum value at full draw.

Figure 15:
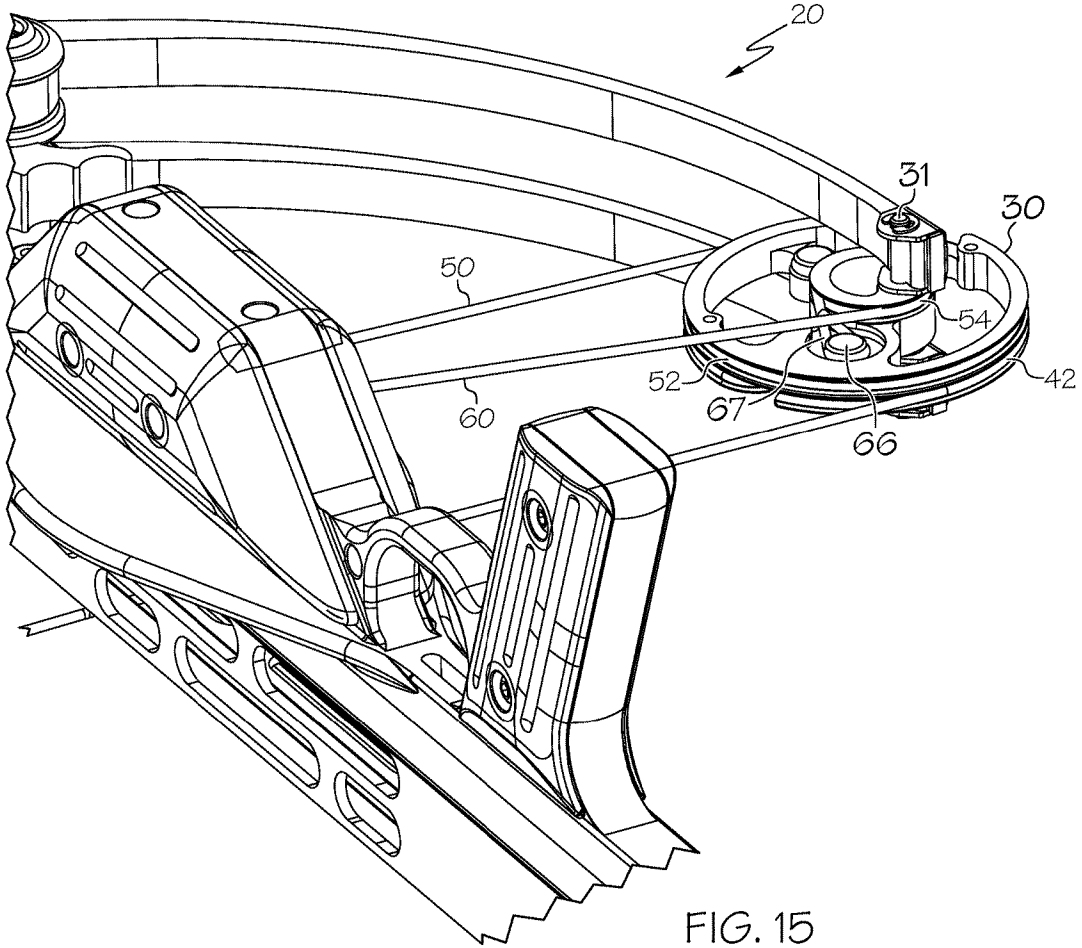
FIG. 15 shows an embodiment of a rotatable member in an embodiment of a compound bow.

FIG. 15 shows an embodiment of a rotatable member 20 on a compound bow 20. In some embodiments, the synchronizing end of a power cable (e.g. 60) wraps around a synchronizer track 54 and terminates on a terminal post 66. In some embodiments, the power cable 60 crosses itself, effectively forming a loop that extends around the rotation axis 31 and synchronizer track 54. In some embodiments, the power cable 60 also comprises a terminal loop 67 for attachment to the terminal post 66.

In some embodiments, the terminal post 66 is located outside of a plane defined by the synchronizer track 54. As shown in FIG. 15, the synchronizer track defines a plane oriented orthogonal to the rotation axis 31. The power cable 60 includes a portion oriented in the plane as the cable 60 extends around the synchronizer track 54. The power cable 60 further includes a terminal portion that is located outside of the plane, for example being offset in a direction lateral to the plane. Offsetting the location of the terminal post 66 allows the cable 60 to cross itself and terminate in a location that would not be available if the terminal post 66 was located in the plane of the synchronizer track 54.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. An archery bow comprising:

a frame supporting a first limb and a second limb;

a first rotatable member supported by the first limb and arranged to rotate about a first rotation axis, the first rotatable member comprising a first synchronizer track, a first cam track, a first bowstring track, a first terminal post, a second terminal post and a first bowstring terminal;

a second rotatable member supported by the second limb and arranged to rotate about a second rotation axis, the second rotatable member comprising a second synchronizer track, a second cam track, a second bowstring track, a third terminal post, a fourth terminal post and a second bowstring terminal;

a bowstring extending between the first rotatable member and the second rotatable member, the bowstring attached to the first bowstring terminal and the second bowstring terminal;

a first power cable comprising a first end portion and a second end portion, the first end portion attached to the fourth terminal post and arranged to be taken up on the second cam track as the bow is drawn, the second end portion attached to the first terminal post and arranged to be fed out from the first synchronizer track as the bow is drawn; and a second power cable comprising a first end portion and a second end portion, the first end portion attached to the second terminal post and arranged to be taken up on the first cam track as the bow is drawn, the second end portion attached to the third terminal post and arranged to be fed out from the second synchronizer track as the bow is drawn;

wherein the first synchronizer track is circular and a centerpoint of the first synchronizer track is offset from the first rotation axis.

2. The archery bow of claim 1, wherein the second synchronizer track is circular and a centerpoint of the second synchronizer track is offset from the second rotation axis.

3. The archery bow of claim 1, wherein the second end portion of the first power cable extends around the first rotation axis and crosses itself adjacent to the first terminal post.

4. The archery bow of claim 1, wherein the first synchronizer track is oriented in a first plane and the first terminal post is oriented in a second plane, the second plane offset from the first plane.

5. The archery bow of claim 4, wherein the first cam track is oriented in the second plane.

6. The archery bow of claim 1, wherein the first cam track is circular and a centerpoint of the first cam track is offset from the first rotation axis.

7. The archery bow of claim 6, wherein the first bowstring track is circular and a centerpoint of the bowstring track offset from the first rotation axis.

8. The archery bow of claim 7, wherein the centerpoint of the first cam track is aligned upon the centerpoint of the first bowstring track.

9. The archery bow of claim 7, wherein the centerpoint of the first synchronizer track, the centerpoint of the first cam track and the centerpoint of the first bowstring track are aligned in a plane that includes the first rotation axis.

10. The archery bow of claim 1, wherein the second end portion of the second power cable extends around the second rotation axis and crosses itself adjacent to the third terminal post.

11. The archery bow of claim 4, wherein the second synchronizer track is oriented in the first plane.

12. The archery bow of claim 11, wherein the third terminal post is oriented in the second plane.

13. The archery bow of claim 4, wherein the second terminal post is oriented in the second plane.

14. The archery bow of claim 4, wherein the first bowstring track is oriented in a third plane, the third plane offset from the second plane.

15. The archery bow of claim 14, the first bowstring terminal oriented in the third plane.

16. The archery bow of claim 14, the second bowstring track oriented in the third plane.

17. The archery bow of claim 1, a shape of the first rotatable member similar to a shape of the second rotatable member.

* * * * *